US005823762A

United States Patent [19]

Anderson et al.

[11] Patent Number: 5,823,762

[45] Date of Patent: Oct. 20, 1998

[54] COHERENT GAS JET

[75] Inventors: John Erling Anderson, Somers, N.Y.; Dennis Robert Farrenkopf, Bethel, Conn.

[73] Assignee: Praxair Technology, Inc., Danbury, Conn.

[21] Appl. No.: 819,811

[22] Filed: Mar. 18, 1997

[51] Int. Cl.[6] ..... F23C 5/00

[52] U.S. Cl. ..... 431/8; 431/4; 431/158; 431/181; 431/187; 239/424.5

[58] Field of Search ..... 431/8, 10, 158, 431/187, 181, 4; 239/424.5, 426

[56] References Cited

U.S. PATENT DOCUMENTS

| | | | |
|---|---|---|---|
| Re. 33,464 | 11/1990 | Gitman | 431/10 |
| 2,380,570 | 7/1945 | Babcock | 239/424.04 |
| 4,130,388 | 12/1978 | Flanagan | 431/10 |
| 4,622,007 | 11/1986 | Gitman | 431/10 |
| 4,797,087 | 1/1989 | Gitman | 431/10 |
| 5,100,313 | 3/1992 | Anderson et al. | 431/8 |

OTHER PUBLICATIONS

Field et al., "Combustion of Pulverised Coal", British Coal Utilisation Research Assoc., (1967).

*Primary Examiner*—Carroll B. Dority
*Attorney, Agent, or Firm*—Stanley Ktorides

[57] ABSTRACT

A system for producing a coherent jet of gas wherein a flame envelope is established around a gas jet and directed toward the center axis of the gas jet.

9 Claims, 4 Drawing Sheets

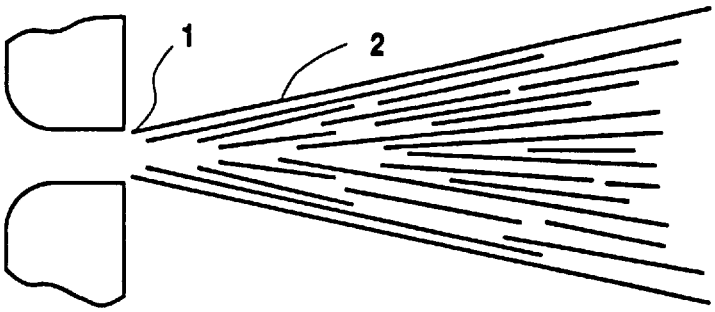
Fig. 1
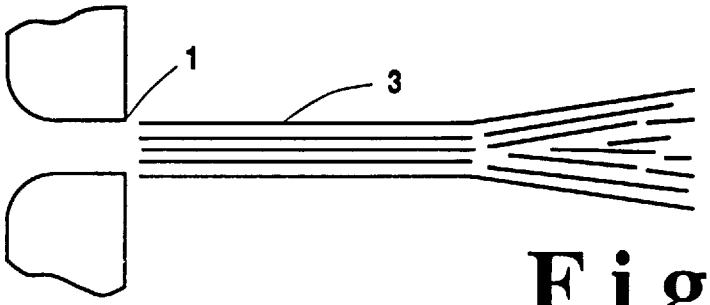
Fig. 2
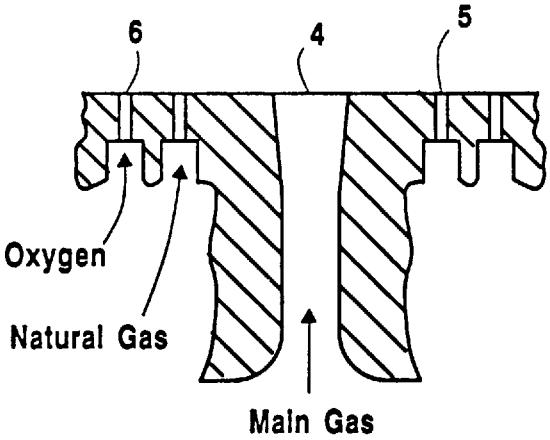
Fig. 3A
Fig. 3B
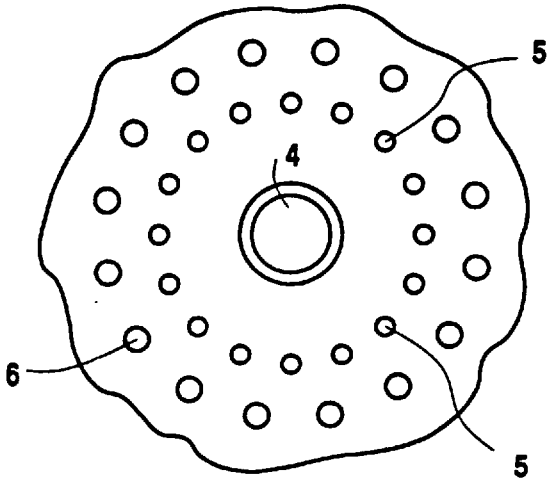

COHERENT GAS JET

BACKGROUND OF THE INVENTION

Field of the Invention

This invention is directed to coherent gas jets, methods of obtaining coherent gas jets and apparatus which can be used to obtain coherent gas jets.

Gas jets, that is, gas which is ejected from a nozzle in a stream-like manner at high velocity, can exist in at least two forms. The two forms of present interest are a conventional, turbulent jet (or as used herein a "normal jet") and a coherent jet.

In a normal jet, gas ejected from a nozzle creates a gas jet. Ambient gas is entrained into the gas jet causing the jet to expand. A typical normal jet is shown in FIG. 1. The gas exits from a nozzle 1, and develops into a normal jet 2. The rate of entrainment of ambient gas can be calculated from an equation given in the literature, "The Combustion of Pulverized Coal" by M. A. Field, D. W. Gill, B. B. Morgan, and P. G. W. Hawksley, The British Coal Utilization Research Association, Chapter 2, Flow Patterns and Mixing, pg. 46. This equation applies after the turbulent jet becomes fully developed which occurs when $x/d_o$ is about 6. At values less than 6, the entrainment rate is lower.

$$\frac{M_a}{M_o} = 0.32\left(\frac{\rho_a}{\rho_o}\right)^{0.5}\frac{x}{d_o}$$

In the foregoing formula, $M_a/M_o$=Ratio of the mass of ambient gas being entrained to the mass of the original gas jet $p_a/p_o$=Ratio of the density of the ambient gas to the density of the original gas jet $x/d$=Axial distance from the nozzle divided by the nozzle diameter For fully developed turbulent flow, the entrainment rate, as indicated by the equation, is quite rapid. For example, if the ambient gas density is equal to that of the original jet gas, then the mass of gas entrained for a jet length equivalent to three nozzle diameters would be approximately equal to the mass of the gas from the original jet. For jet lengths of 3, 6, and 9 nozzle diameters, the mass of gas entrained would be respectively 1, 2, and 3 times that of the initial jet gas.

In contrast to a normal jet, there is very little entrainment of ambient gas into a coherent jet for a considerable distance from the nozzle face. The jet remains relatively coherent with very slight expansion, as shown in FIG. 2. In FIG. 2 the gas exits from a nozzle 1, and develops into a coherent jet 3. Typically, the jet can remain coherent for a jet length of about 50 nozzle diameters or more before it transforms into a normal jet.

In an oxy-cutting torch, the oxygen jet is surrounded by a ring of reducing flames, either premixed, i.e. the fuel and oxidant gases are mixed before exiting the nozzle, or post-mixed, i.e. the fuel and oxidant gases are mixed after exiting separate nozzles. Within this hot flame envelope, the oxygen jet becomes coherent so that a straight, smooth cut can be made as the oxygen jet impinges into the carbon steel. If the jet were not coherent, a ragged cut of poor quality would result.

Equipment used to obtain a coherent oxygen jet in the prior art and in obtaining data used in the present application is shown in FIGS. 3A and 3B. As shown in FIGS. 3A and 3B, the main gas, in this case oxygen, passes through a converging-diverging nozzle 4 to obtain supersonic flow. An inner ring of holes 5 for natural gas and an outer ring of holes 6 for oxygen are also provided.

In the test apparatus, the converging-diverging nozzle 4, had a throat diameter of 0.427 inches and an exit diameter of 0.580 inches. The inner ring of holes 5 and were 16 in number, each 0.113 inches in diameter and evenly spaced around a 1⅝ inch diameter circle. The outer ring of holes 6 and were also 16 in number, each 0.161 inches in diameter and evenly spaced around a 2¼ inch diameter circle. Tests were run with this apparatus using a pitot tube to determine the jet velocity along the jet axis. Methods of using a pitot tube to measure gas velocity are well-known in the art. Pitot tubes measure local or point velocities by measuring the difference between impact pressure and static pressure. Measurements were made with post-burning flames (1200 CFH natural gas and 1200 CFH oxygen) and also without post-burning flames.

Plots of the gas velocity versus the axial distance from the nozzle are given in FIG. 4. As can be readily seen from FIG. 4, without the flames, there was a sharp drop in gas velocity along the jet axis. With the flames, the jet velocity at the axis remained essentially constant at a supersonic velocity (e.g. Mach 1 or greater) for a jet length of 24 inches (indicating the jet was coherent) before starting to decline. The difference between the two curves in FIG. 4 is quite dramatic. The measured entrainment of gas into the coherent portion of the jet was about 5% of that calculated using the equation for a normal jet.

If a normal jet of argon were used to penetrate a bath of molten steel to induce stirring, for it to be effective it would have to be placed so close to the molten bath that the nozzle would corrode. If a normal jet of a length sufficient to avoid corrosion of the nozzle were used, it would entrain a large amount of ambient gas before the jet impinged the bath surface. Consequently, such a normal jet would have a broad, low velocity profile, and would be ineffective in penetrating the metal bath.

It is therefore an object of this invention to provide a coherent gas jet using gas other than oxygen, to provide methods of obtaining coherent gas jets, to provide improved oxygen coherent jets, and to provide apparatus which can produce coherent gas jets. This invention contemplates the use of any gas, including reactive and inert gases.

Accordingly, we have developed coherent gas jets, and methods and apparatus for making them which were unavailable in the prior art.

SUMMARY OF THE INVENTION

Our invention includes coherent gas jets, where the jet gas may be reactive or non-reactive. Suitable gases include nitrogen, argon, carbon dioxide and fuel gases including natural gas or propane.

The present invention also includes a method of producing a coherent gas jet. This is accomplished by surrounding the gas jet with flames which are deflected in towards the center axis of the main gas jet. Using this method, a long coherent jet comprising any gas can be obtained.

The present invention also includes apparatus which can direct the flames toward the center axis of the gas jet, and therefore obtain a long, coherent jet. Such an apparatus may include deflectors which narrow the flame envelope surrounding the gas and point the flames in toward the axis of the jet of gas. Such an apparatus may be mounted on existing devices, such as that shown in FIGS. 3A and 3B, or may be made entirely anew. Suitable devices include nozzle type devices which may be positioned over the flame/gas combination as the flames and gas initially exit, and which point the flames inward. The invention also includes apparatus which deflect the oxidant gas into the fuel gas to cause the flames to be directed toward the main gas jet, and apparatus which provides the nozzles for the fuel and oxidant gases at an angle such that the flames exit the nozzles and are directed toward the lateral axis of the main gas jet to produce a coherent gas jet, without the use of additional deflection devices.

BRIEF DESCRIPTION OF THE DRAWINGS

FIG. 1 is a representation of a conventional, turbulent jet, or a "normal" jet.

FIG. 2 is a representation of a coherent jet.

FIGS. 3A and 3B are representations of equipment which can be used to obtain an oxygen coherent jet.

FIG. 3A is a cross-sectional view and FIG. 3B is an overhead view.

Figure 4:
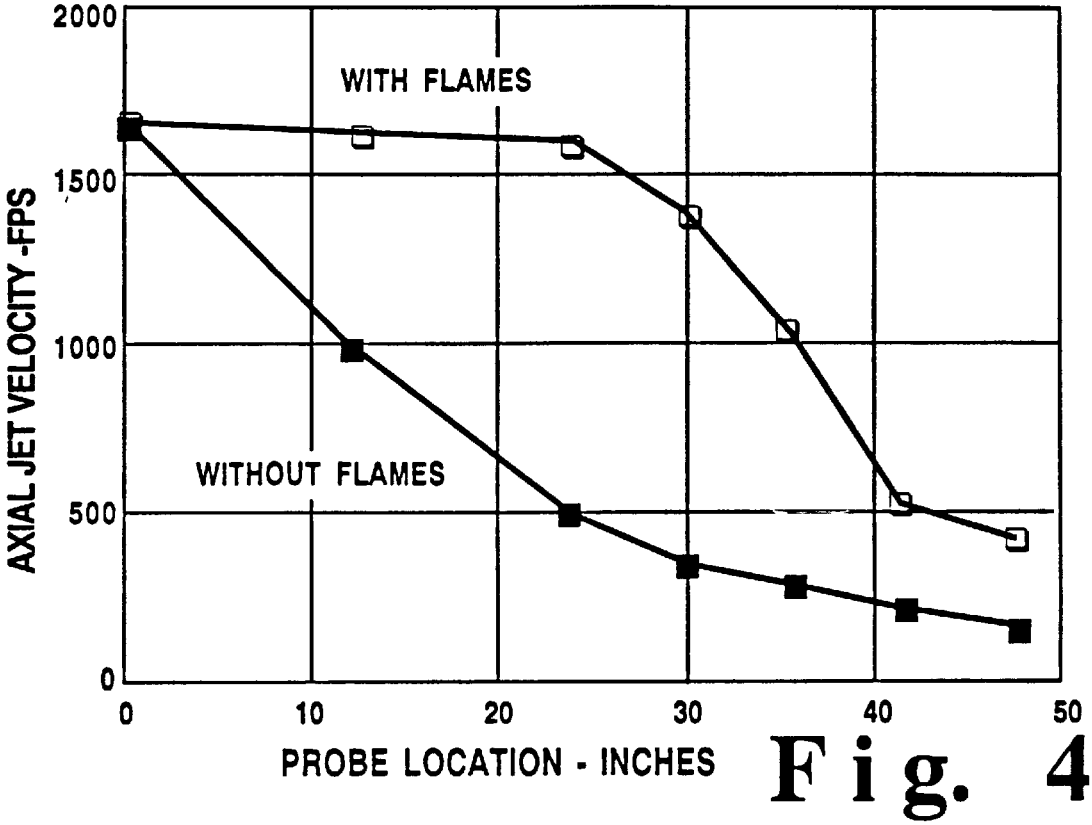
FIG. 4 is a graph showing the velocity along the axis for an oxygen jet with and without a flame envelope.

The numerals in the drawings are the same for the common elements.

DETAILED DESCRIPTION OF THE INVENTION

The present invention includes coherent gas jets. Such coherent gas jets maintain or closely maintain the velocity of the gas stream as it exits the nozzle with very slight expansion, since there is very little entrainment of ambient gas into a coherent jet for a considerable distance from the nozzle face. A typical coherent jet can remain coherent for a jet length of about 50 nozzle diameters or more before transforming into a normal jet.

Gases which can be used to form a coherent jet include inert or non-reactive gases, and reactive gases.

Examples of inert or non-reactive gases include nitrogen, argon and carbon dioxide. Mixtures of gases may also be used to form the main gas jet.

Examples of reactive gases which would provide useful coherent gas jets include oxygen and fuel gases, such as propane and natural gas as well as mixtures thereof.

The coherent gas jets according to this invention are obtained by surrounding the gas which is to form the jet, or main gas, with flames and directing the flames toward the center axis of the gas jet. The objects of the invention can be achieved with subsonic and supersonic gas velocities for the coherent jet. However, it is more effective if the gas velocity is supersonic, that is, Mach 1 or greater.

The device used to create a flame-surrounded gas jet may be the same type of device previously discussed herein, and shown in FIGS. 3A and 3B. In such an apparatus, the gas which will form the jet is positioned at the centermost of a series of concentric rings. The jet gas is surrounded by two rings of holes, capable of separately supplying an oxidant and a fuel gas used to create the flames. The number, size and arrangement of holes for the oxidant and fuel gas are selected to permit the formation of a flame envelope which can be deflected toward the center of the gas jet. As previously discussed in the device shown in FIGS. 3A and 3B, the inner ring of holes are used for natural gas, and the outer ring of holes are used for oxygen. It is also possible to operate with the inner ring of holes used for oxygen and outer ring of holes used for natural gas. Fuel and oxidant gases can also be supplied via concentric, annular rings.

The gases used to create the flame envelope which surrounds the jet gas may be any of those known to those of ordinary skill in the art. For example, oxidants containing 30 to 100 volume % oxygen can be used. Oxidants with greater than 90 volume % oxygen are preferred. The fuel gas can be any of those known in the art, including hydrogen, propane, natural gas, and other hydrocarbon fuel.

The fuel and oxidant gases may be either pre-mixed or post-mixed. Post-mixed flames are preferred as being safer.

Figure 5:
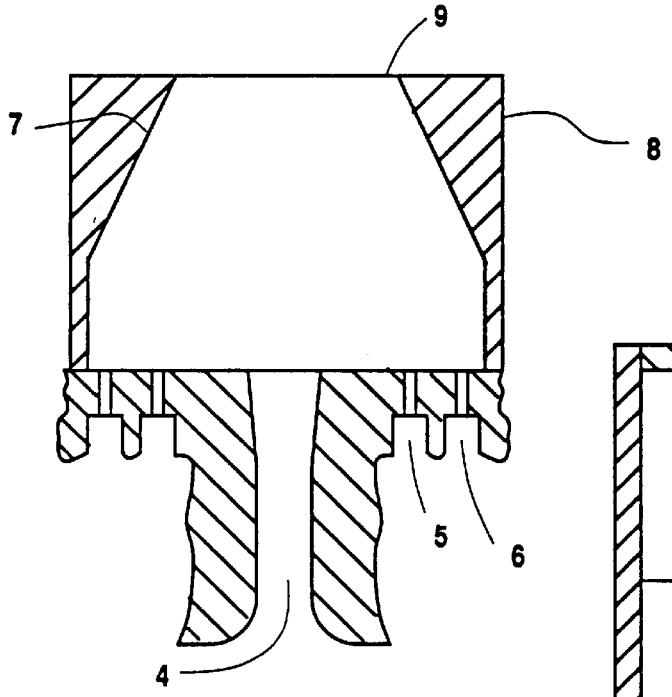
FIG. 5 is a sketch of a flame deflector attached to the jet equipment illustrated in FIGS. 3A and 3B.

A coherent gas jet is obtained by using an apparatus which deflects the flames toward the center axis of the gas jet in conjunction with an apparatus such as that shown in FIGS. 3A and 3B. An example of such a deflector is shown in FIG. 5. This deflector can be positioned on top of the structure shown in FIGS. 3A and 3B. It can be seen from study of FIG. 5, that the inner solid walls 7 of the deflector 8, converge toward the center axis of the main gas jet axis at an angle of approximately 25 degrees. This converging wall structure causes the flame envelope created by the exiting fuel and oxidant to be directed toward the center axis of the jet gas as it leaves the deflector at exit 9, resulting in a coherent gas jet.

While the embodiment shown in FIG. 5 shows a particular angle of deflection, the present invention is not so limited. Any angle which causes the flames to be directed toward the gas jet and provides a coherent gas jet is within the scope of this invention. Angles of deflection up to 90 degrees are therefore believed to be suitable.

A flame is established around the main jet near the nozzle face by deflecting the flame envelope towards the main jet axis.

The invention is demonstrated in the following examples. While the examples show specific flow rates for the main gas, fuel and oxidant gases, it is to be understood that the invention is not so limited, and one of ordinary skill in the art can select appropriate flow rates for these gases.

EXAMPLE 1

The deflector exemplified in FIG. 5, is attached to the gas jet and flame apparatus shown in FIGS. 3A and 3B. Post burning flames were used, with 1200 CFH of natural gas exiting the inner ring of holes and 1200 CFH oxygen exiting the outer ring of holes, to create a flame pattern. Nitrogen was used as the main, or jet, gas at a flow rate of about 21,000 CFH with a pressure upstream of the nozzle of 125 psig.

The gas velocity along the jet axis was measured with a pitot tube. Measurements were made with and without a flame deflector. As can be readily seen from FIG. 6, which is a graph of the velocity along the axis of the nitrogen jet measured with and without the flame deflector, a marked improvement was obtained by using the flame deflector.

Figure 6:
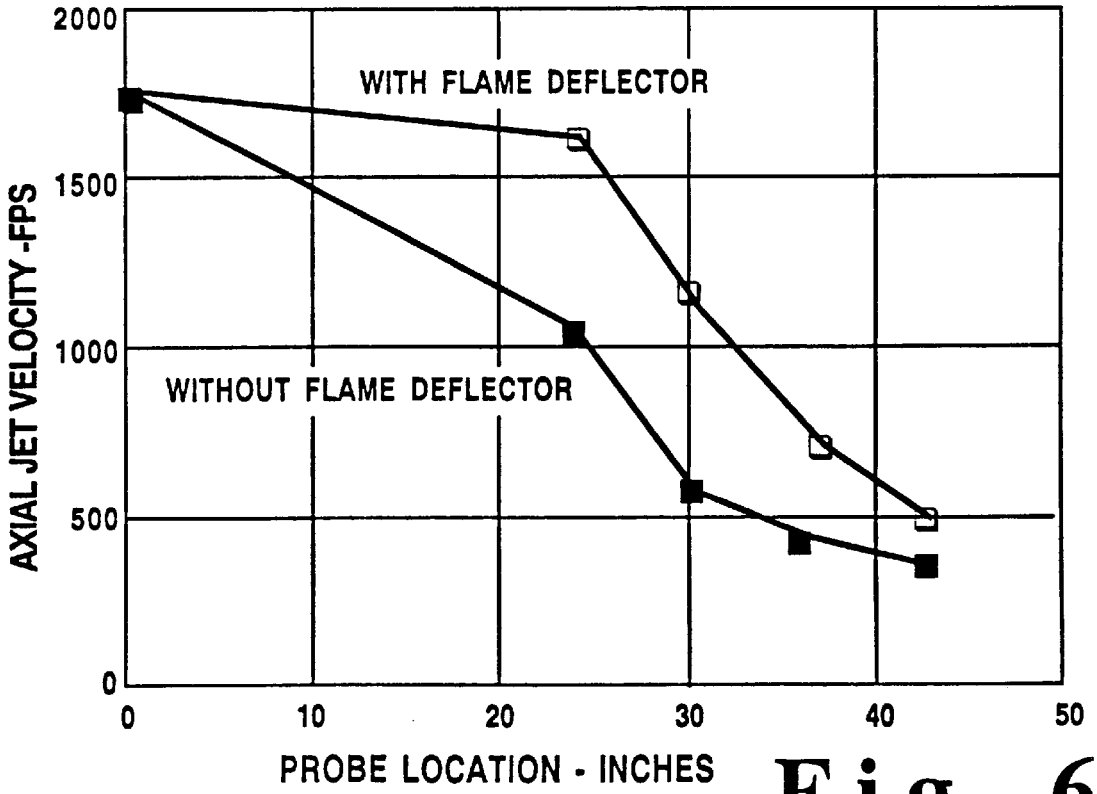
FIG. 6 is a graph showing the velocity along the jet axis for a nitrogen jet with and without the flame deflector.

As shown in FIG. 6, the velocity of nitrogen remained above 1500 feet per second (fps) for about 25 inches from the nozzle exit with the flame deflector. Without the flame deflector, the nitrogen velocity, at a point 25 inches from the nozzle, fell to about 1000 fps. Thus, the nitrogen jet was more coherent with the velocity being consistently higher along the jet axis when the flame deflector was used.

EXAMPLE 2

Using argon as the main, or jet gas, the post-mixed flames (hole size, geometry and flow rates) were the same as that for the previously described tests with oxygen and nitrogen. The converging-diverging nozzle, designed for argon, had a 0.438" diameter throat and a 0.554" diameter exit. The argon flow rate was 20,000 CFH with a 120 psig pressure upstream of nozzle.

Figure 7:
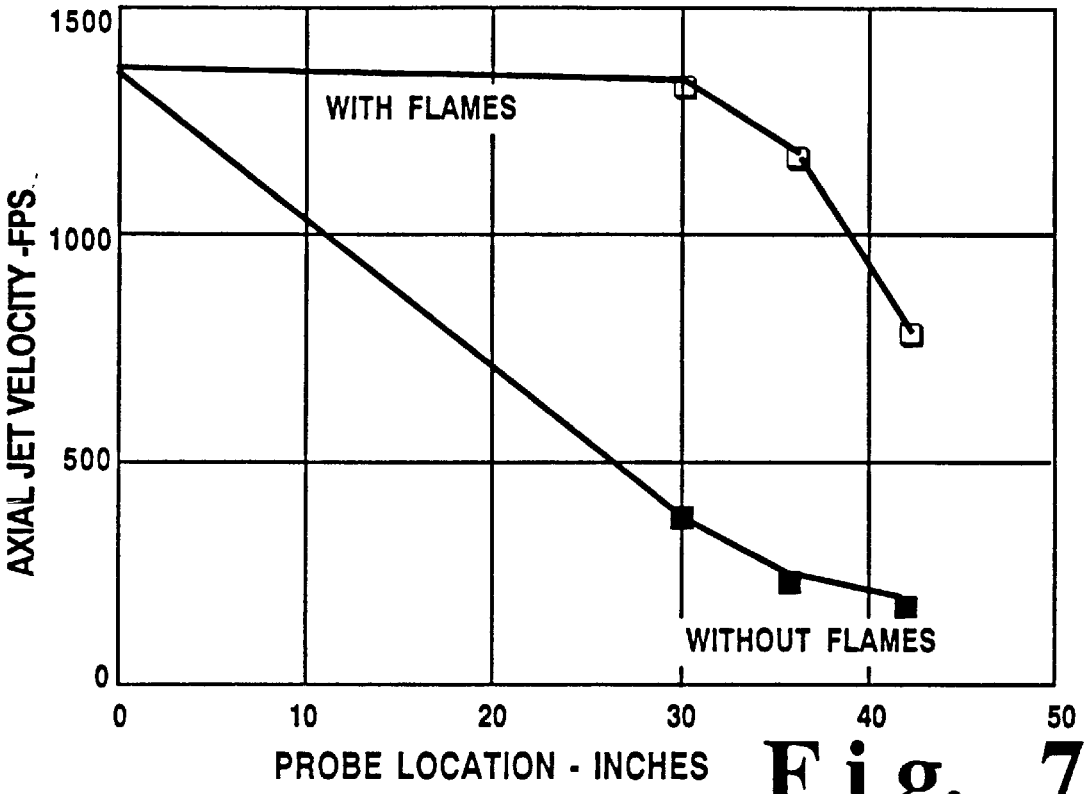
FIG. 7 is a graph showing the velocity along the jet axis for an argon jet with and without a flame envelope.

Measurements of gas velocity were made with a deflected flame and without the flame envelope. Plots of the velocity along the axis for operation with and without the flames are given in FIG. 7. With the flame and deflector, a long coherent jet was obtained. The difference between operation with and without the flames was similar to the results with oxygen. A comparison of the jet velocity at a probe distance of 36" from the nozzle face was made with and without the flame deflector. The measured velocity was 1210 fps with the deflector and 850 fps without it. The flame deflector made a big difference.

EXAMPLE 3

Figure 8:
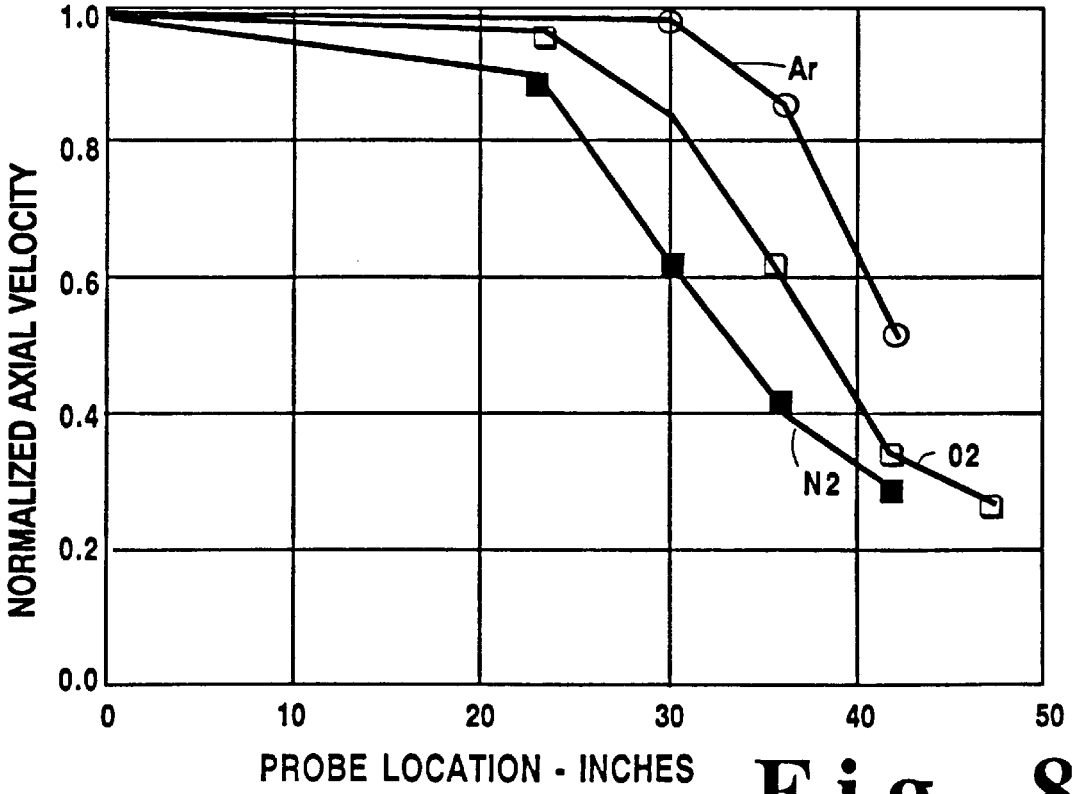
FIG. 8 is a graph comparing coherent jets of oxygen (without a flame deflector) with coherent jets of nitrogen and argon (with flame deflectors).

A direct comparison of the three gases (argon and nitrogen with the flame deflector and oxygen without the flame deflector) is presented in FIG. 8. The velocity was normalized, dividing the velocity along the jet axis by the velocity at the nozzle exit. The plots clearly show that by using the flame deflector, coherent jets comparable to those obtained with oxygen can be achieved with essentially any gas. The length of the coherent portion of the jet increased in going from nitrogen to oxygen to argon. This can probably be attributed to the increase in gas density. It is expected that the length of the coherent jet would increase as the gas density increases.

Figure 9:
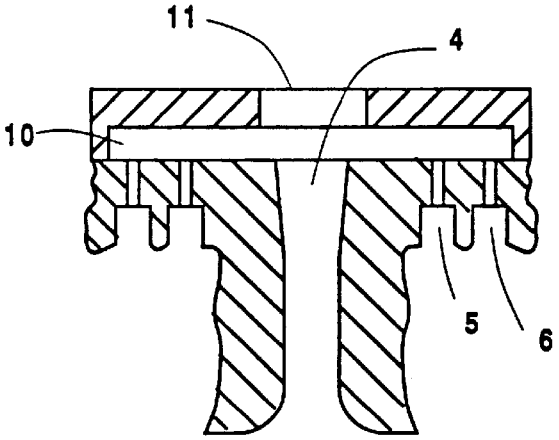
FIG. 9 is representation of another embodiment of a flame deflector which can be used in accordance with the present invention.

There are different ways to deflect the flame towards the jet axis to obtain coherent jets. Another preferred embodiment of a deflector is illustrated in FIG. 9. In this embodiment, the gap between the nozzle face for the main gas 4 and the deflector 10, is small resulting in an increased radial velocity of fuel gas, oxygen and combustion products towards the jet axis. Here the angle of deflection of the flames is about 90 degrees. In this embodiment, the flames are deflected in toward the jet gas before leaving the deflector exit 11.

Another approach to simulate the effect of a flame deflector would be to angle the holes for the fuel gas and/or the oxygen in towards the jet axis.

Figure 10:
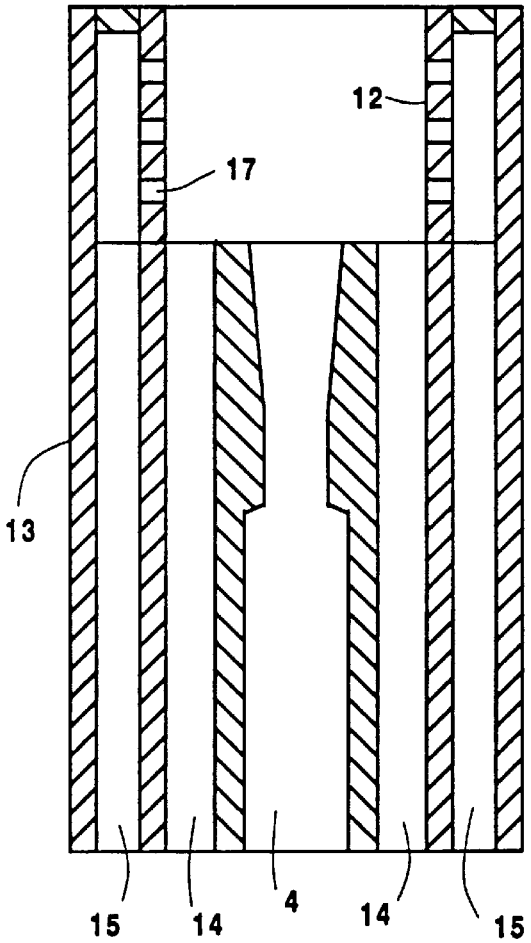
FIG. 10 is a cross-sectional view of an embodiment of the invention which deflects the oxidant gas to direct the flames toward the main gas jet.

A preferred means of obtaining a coherent jet using a gas other than oxygen is depicted in FIG. 10. FIG. 10 shows a deflection device 12 which is seated on a gas-supplying structure 13. The main gas, shown as nitrogen in FIG. 10, is supplied through the center nozzle 4, and the fuel and oxidant gases are supplied through annuli 14 and 15 respectively. As can be seen from FIG. 10, the main gas and fuel gas flow up through the annulus and nozzle 4 unimpeded. The deflection device 12, however directs the flow of oxidant gas into the flow of fuel gas by means of holes 17, set around the circumference, directed toward the main gas jet axis.

Using the device shown in FIG. 10, with nitrogen as the main gas and natural gas and oxygen to supply the flame envelope, it was found that the oxygen stream for each hole 17 penetrated the annulus of natural gas, and a flame was observed around the main jet at the nozzle face. Thus, instead of using a solid deflector, the low velocity oxygen gas was used to deflect the flame towards the main jet. It is believed this method may be more effective than the other devices discussed herein when using inert gases.

A deflector can be used for all jet gases. For gases other than oxygen, the effect of the deflector can be very significant as illustrated herein for tests with either nitrogen or argon as the main gas. If oxygen is the main gas, the improvement using the deflector may be small. However, even with oxygen, the use of the deflector ensures that the conditions are favorable for obtaining a long coherent jet.

In practicing the present invention, it is not only important to deflect the flames towards the jet gas, it is also important to maintain the flow rates for the fuel gas and oxidant to create the flames surrounding the jet, within certain guidelines. The guidelines use the following symbols.

Q—Firing rate (LHV) for the fuel gas—MMBtu/hr (million Btu/hr)

V—Volumetric flow rate for the oxidant—MCFH (thousands of cubic feet per hour) at 60 degrees F. and atmospheric pressure.

P—Volume % oxygen in the oxidant

D—Nozzle exit diameter—inches

The volume % oxygen in the oxidant (P) should be greater than 30% and preferably greater than 90%. The ratio Q/D should be greater than 0.6 and preferably about 2.0. The function VP/D should be greater than 70 and preferably about 200.

Additionally, combustion instabilities, such as discontinuities in the flame or fuel and oxidant gases, should be avoided.

Materials used to construct the nozzles and deflectors are well-known in the art and include stainless steel, copper and in some applications, refractory type materials.

The nozzle and deflector can be cooled during operation, depending upon the end-use of the coherent jet. For example, if the jet is to be used in a furnace, cooling of the nozzle would be appropriate. Methods known to those of skill in the art, including water and air cooling would be suitable.

As can be seen from the foregoing disclosure, we have succeeded in obtaining new coherent gas jets which are not limited to any particular type of gas. Nor is the present invention limited to any particular means to deflect flames towards the center axis of a main gas to create a coherent jet.

We claim:

1. A method of forming a coherent gas jet comprising:

a) providing a main gas through a converging/diverging nozzle, so that the main gas exits the nozzle to form a main gas jet having a center axis, said main gas being a non-reactive gas selected from the group consisting of nitrogen, argon, carbon dioxide, and mixtures thereof;

b) supplying a flow of fuel gas around the main gas jet and a flow of oxidant gas around the flow of fuel gas and forming a flame envelope from the fuel gas and the oxidant gas, said flame envelope surrounding the main gas jet; and c) directing said flame envelope toward the center axis of the main gas jet.

2. The method according to claim 1 where the main gas exits the nozzle at a velocity equal to or greater than about Mach 1.

3. The method according to claim 1 where the oxidant contains oxygen at a volume % of 30% or more, the ratio of a firing rate for the fuel gas, in million Btu/hr, to the nozzle exit diameter, in inches, is 0.6 or greater and the volumetric flow rate for the oxidant, in thousands of cubic feet per hour, multiplied by the volume % oxygen in the oxidant, divided by the nozzle exit diameter, in inches, is greater than 70.

4. The method of claim 1 wherein the flame envelope is directed toward the gas jet at an angle of from about 25 to about 90 degrees.

5. The method of claim 1 wherein the flame envelope is directed toward the center axis of the jet created by the main gas by using a deflecting apparatus.

6. The method of claim 1 wherein the flame envelope is directed toward the center axis of the jet created by the main gas by adjusting the angle of exit of the fuel and oxidant gas.

7. An apparatus for creating a coherent gas jet comprising:

a) a converging/diverging main gas nozzle connected to a main gas source capable of ejecting a main gas at a high velocity to create a main gas jet having a center axis, said main gas being a non-reactive gas selected from the group consisting of nitrogen, argon, carbon dioxide, and mixtures thereof;

b) means for creating a flame envelope around said main gas jet comprising an inner circle of exit holes connected to a fuel gas source and an outer circle of exit holes connected to an oxidant gas source where the outer and inner circles are concentric with each other and the main gas nozzle; and c) means for directing said flame envelope toward said main gas jet.

8. The apparatus of claim 7 where the means for directing the flame envelope comprises a deflector having walls angled in towards the center axis of the main gas jet.

9. The apparatus of claim 7 where the means for directing the flame envelope comprises means for directing an oxidant gas to penetrate through a fuel gas used to create the flame envelope, whereby the flame envelope is directed toward the main gas jet.

* * * * *